US011491622B2

(12) United States Patent
Weigmann et al.

(10) Patent No.: US 11,491,622 B2
(45) **Date of Patent: *Nov. 8, 2022**

(54) DRIVING TOOL FOR DRIVING FASTENING MEANS INTO A WORKPIECE

(71) Applicant: Illinois Tool Works Inc., Glenview, IL (US)

(72) Inventors: Torsten Weigmann, Ronnenberg (DE); Klaus Von Soest, Winzenburg (DE); Olaf Haehndel, Plattensen (DE)

(73) Assignee: Illinois Tool Works Inc., Glenview, IL (US)

( * ) Notice: Subject to any disclaimer, the term of this patent is extended or adjusted under 35 U.S.C. 154(b) by 79 days.

This patent is subject to a terminal disclaimer.

(21) Appl. No.: 16/874,243

(22) Filed: May 14, 2020

(65) Prior Publication Data

US 2020/0269403 A1 Aug. 27, 2020

Related U.S. Application Data

(63) Continuation of application No. 14/898,212, filed as application No. PCT/US2014/035108 on Apr. 23, 2014, now Pat. No. 10,688,641.

(30) Foreign Application Priority Data

Jun. 25, 2013 (DE) ..... 10 2013 106 658.5

(51) Int. Cl.
*B25C 1/00* (2006.01)
*B25C 1/04* (2006.01)
*B25C 1/06* (2006.01)

(52) U.S. Cl.
CPC ..... *B25C 1/008* (2013.01); *B25C 1/04* (2013.01); *B25C 1/06* (2013.01)

(58) Field of Classification Search
CPC .. B25C 1/00; B25C 1/008; B25C 1/06; B25C 1/047; B25C 1/04; B25C 1/041; B25C 1/043; B25C 5/13; G06F 3/016
(Continued)

(56) References Cited

U.S. PATENT DOCUMENTS 3,467,294 A 9/1969 Fisher
3,479,926 A 11/1969 Hillier
(Continued)

FOREIGN PATENT DOCUMENTS

CN 1788940 6/2006
CN 101284374 10/2008
(Continued)

OTHER PUBLICATIONS

International Search Report and Written Opinion for PCT/US2014/035108 dated Aug. 11, 2014, 11 pages.

*Primary Examiner* — Thomas M Wittenschlaeger
*Assistant Examiner* — Katie L Gerth
(74) *Attorney, Agent, or Firm* — Neal, Gerber & Eisenberg LLP

(57) ABSTRACT

This relates to a driving tool for driving fastening means, nails/staples, into a workpiece, a trigger lever, which can be actuated manually, and a workpiece contact element, which can be actuated by placing the tool onto the workpiece, the tool operates in a single shot mode, in which each individual sequence of an actuation of the workpiece contact element with subsequent actuation of the trigger lever triggers a driving-in cycle, the tool operates in a bump firing mode, in which, with the trigger lever continuously actuated, each individual actuation of the workpiece contact element triggers a driving-in cycle, a resetting assembly providing, by means of which the tool is resettable from the bump firing mode into single shot mode in an automatic, time-controlled
(Continued)

resetting operation. It is proposed that a signaling assembly, which emits a feedback signal to the user before, after or during each automatic resetting operation, is provided.

15 Claims, 4 Drawing Sheets

(58) Field of Classification Search
USPC ..... 227/8
See application file for complete search history.

(56) References Cited

U.S. PATENT DOCUMENTS 3,572,572 A * 3/1971 Readyhough ..... B25C 1/008 227/8
3,580,455 A 5/1971 Cast
3,583,496 A 6/1971 Fehrs
3,786,978 A 1/1974 Manganaro
3,964,659 A * 6/1976 Eiben ..... B25C 1/043 227/8
4,351,464 A 9/1982 Fehrs
4,550,643 A 11/1985 Schwartzenberger
4,679,719 A 7/1987 Kramer
5,191,861 A 3/1993 Kellerman et al.
5,197,646 A 3/1993 Nikolich
5,551,620 A 9/1996 Vallee
5,605,268 A 2/1997 Hayashi et al.
5,687,897 A 11/1997 Fa
5,732,870 A 3/1998 Moorman et al.
5,772,096 A 6/1998 Osuka et al.
5,785,228 A * 7/1998 Fa ..... B25C 1/046 227/130
5,862,969 A 1/1999 Lee
5,918,788 A 7/1999 Moorman et al.
6,095,392 A 8/2000 Batts, Jr.
6,123,241 A * 9/2000 Walter ..... B25C 1/08 123/46 SC
6,213,372 B1 4/2001 Chen
6,357,647 B1 3/2002 Ou
6,371,348 B1 4/2002 Canlas et al.
6,382,492 B1 5/2002 Moorman et al.
6,431,425 B1 8/2002 Moorman et al.
6,450,387 B1 9/2002 Chen
6,543,664 B2 4/2003 Wolfberg
6,604,664 B2 8/2003 Robinson
6,691,907 B1 2/2004 Chang
6,695,193 B1 2/2004 Chang
6,695,194 B1 2/2004 Chang
6,722,548 B2 * 4/2004 Odoni ..... B25C 1/08 227/10
6,796,475 B2 * 9/2004 Adams ..... B25C 1/06 227/129
6,857,547 B1 2/2005 Lee
7,070,080 B2 7/2006 Lin
7,143,918 B2 12/2006 Aguirre et al.
7,163,134 B2 1/2007 Moeller et al.
7,191,927 B2 3/2007 Segura
7,196,688 B2 * 3/2007 Schena ..... G01D 7/007 345/156
7,383,974 B2 6/2008 Moeller
7,469,811 B2 12/2008 Shima et al.
7,469,818 B2 12/2008 Saltsor et al.
7,510,105 B2 3/2009 Moeller et al.
7,513,402 B2 4/2009 Miyashita
7,726,536 B2 * 6/2010 Gross ..... B25C 1/06 227/134
7,828,072 B2 11/2010 Hashimoto et al.
7,938,305 B2 5/2011 Simonelli et al.
7,971,766 B2 7/2011 Tang
7,975,890 B2 7/2011 Tang
8,011,441 B2 9/2011 Leimbach et al.
8,011,547 B2 9/2011 Leimbach et al.
8,215,528 B2 * 7/2012 Matsunaga ..... B25C 1/08 227/8
8,313,012 B2 * 11/2012 Shima ..... B25C 1/06 227/8
8,336,749 B2 12/2012 Largo
8,348,118 B2 1/2013 Segura
8,403,072 B2 * 3/2013 Eshleman ..... B25B 21/008 173/1
8,608,044 B2 * 12/2013 Hueil ..... A61B 50/30 227/175.2
9,061,407 B2 6/2015 Chien et al.
9,242,359 B2 1/2016 Staples
9,381,663 B2 7/2016 Maurer
9,486,907 B2 11/2016 Birk
9,550,288 B2 1/2017 Moore et al.
9,782,879 B2 10/2017 Baur
9,782,880 B2 10/2017 Moore et al.
10,213,911 B2 2/2019 Moore et al.
2001/0006183 A1 7/2001 Mukoyama
2002/0021601 A1 * 2/2002 Chornenky ..... G07C 9/00182 365/200
2002/0054060 A1 * 5/2002 Schena ..... G05G 9/047 715/701
2002/0130154 A1 9/2002 Wolfberg
2002/0185514 A1 12/2002 Adams et al.
2003/0121947 A1 7/2003 Hsu
2004/0045997 A1 3/2004 Birk
2005/0023318 A1 * 2/2005 Aguirre ..... B25C 1/008 227/8
2005/0029323 A1 2/2005 Shima
2005/0173484 A1 8/2005 Moeller
2005/0173487 A1 8/2005 Moeller et al.
2005/0217874 A1 * 10/2005 Forster ..... B25F 5/00 173/1
2005/0217875 A1 * 10/2005 Forster ..... B25C 1/06 173/1
2005/0220445 A1 10/2005 Baskar
2007/0004984 A1 * 1/2007 Crum ..... A61B 8/06 600/471
2007/0131731 A1 6/2007 Moeller
2007/0278275 A1 * 12/2007 Ho ..... B25C 1/008 227/8
2008/0017689 A1 * 1/2008 Simonelli ..... B25C 1/008 227/132
2008/0073405 A1 3/2008 Shima
2008/0251558 A1 10/2008 Suda
2009/0057365 A1 3/2009 Murayama
2009/0159633 A1 * 6/2009 Wu ..... B25C 1/008 227/8
2009/0236387 A1 * 9/2009 Simonelli ..... B25C 5/1668 227/8
2009/0242604 A1 * 10/2009 Mina ..... B25C 1/047 227/8
2009/0250500 A1 10/2009 Brendel
2009/0314818 A1 * 12/2009 Segura ..... B25C 1/008 227/8
2010/0116863 A1 * 5/2010 Suda ..... B25C 1/008 227/8
2010/0173686 A1 * 7/2010 Grant ..... A63F 13/42 463/2
2010/0236911 A1 * 9/2010 Wild ..... H01H 3/022 200/345
2010/0237124 A1 9/2010 Shima
2010/0243699 A1 9/2010 Largo
2011/0084109 A1 * 4/2011 Ford ..... B25C 1/08 227/2
2011/0248061 A1 * 10/2011 Liu ..... B25C 1/008 227/8
2012/0022525 A1 * 1/2012 Dietz ..... A61B 18/085 606/45
2012/0041436 A1 * 2/2012 Ullrich ..... A61B 18/12 606/39
2012/0097730 A1 4/2012 Liang et al.
2012/0104070 A1 * 5/2012 Wu ..... B25C 1/06 227/8
2012/0118932 A1 5/2012 Largo
2012/0138658 A1 * 6/2012 Ullrich ..... A61B 17/072 227/175.1

(56) References Cited

U.S. PATENT DOCUMENTS

2012/0298390 A1* 11/2012 Schieler ..... B25C 1/04 173/20
2013/0041368 A1* 2/2013 Cunningham ..... A61B 34/76 606/34
2013/0062390 A1* 3/2013 Yeh ..... B25C 1/047 227/8
2013/0193188 A1* 8/2013 Shelton, IV ..... A61B 17/068 227/175.2
2013/0206814 A1* 8/2013 Morgan ..... A61B 34/30 606/1
2015/0001272 A1* 1/2015 Sniffin ..... A61B 17/064 227/175.1
2015/0314432 A1* 11/2015 Yang ..... B25C 1/008 227/8
2016/0136797 A1* 5/2016 Weigmann ..... B25C 1/06 227/8
2017/0050305 A1 2/2017 Birk
2019/0184536 A1 6/2019 Moore et al.

FOREIGN PATENT DOCUMENTS

| | | |
|---|---|---|
| CN | 101743099 | 6/2010 |
| DE | 202013001537 | 3/2013 |
| EP | 0736360 | 10/1996 |
| EP | 1223009 | 7/2002 |
| EP | 1240982 | 9/2002 |
| EP | 1980367 | 10/2008 |
| EP | 2450152 | 5/2012 |
| JP | H08276375 | 10/1996 |
| JP | 2002346946 | 12/2002 |
| WO | WO2002051591 | 7/2002 |

* cited by examiner

DRIVING TOOL FOR DRIVING FASTENING MEANS INTO A WORKPIECE

PRIORITY

This application is a continuation of, and claims priority to and the benefit of U.S. patent application Ser. No. 14/898,212, filed on Dec. 14, 2015, which claims priority to and the benefit of U.S. National Stage Application No. PCT/US2014/035108 filed Apr. 23, 2014, which claims priority to and the benefit of German Patent Application No. 10 2013 106 658.5, filed Jun. 25, 2013, the entire contents of each of which are incorporated herein by reference.

BACKGROUND

The present invention relates to a driving tool for driving fastening means into a workpiece and to a method for operating such a driving tool.

The driving tool in question is used primarily as a handheld tool, for example for fastening particle boards on supporting structures. The term "fastening means" should be understood here in a broad sense and comprises not only nails and staples but also screws, pins or the like. The main focus of attention here is on the driving in of nails, which should not be understood as being restrictive.

The fastening means usually take the form of a magazine belt. Depending on the design, the magazine belt may for example have a carrier belt of plastic or metal, which carries the individual fastening means. Another variant is that of providing a series of parallel running fastening wires, which are tacked on to the individual fastening means.

The driving tool in question may be designed as a compressed-air-operated driving tool, as a combustion-powered driving tool or as an electrically operated driving tool or the like.

The known driving tool (U.S. Pat. No. 6,604,664 B2), on which the invention is based, is designed as a compressed-air-operated driving tool. It is provided with a pneumatic actuator unit, which serves for driving in the fastening means in individual driving-in cycles.

For triggering the driving-in cycles of the pneumatic actuator unit, a triggering assembly is provided, having a trigger lever that can be actuated manually and a workpiece contact element that can be actuated by placing the driving tool onto the workpiece.

What is advantageous about the known driving tool is the fact that it can be operated in two different operating modes. In the single shot mode, each individual sequence of an actuation of the workpiece contact element (from the unactuated state of the workpiece contact element) with subsequent actuation of the trigger lever (from the unactuated state of the trigger lever) triggers a driving-in cycle. In the bump firing mode, with the trigger lever continuously actuated, each individual actuation of the workpiece contact element (in each case from the unactuated state) triggers a driving-in cycle.

In the case of the known driving tool, a resetting from the bump firing mode into the single shot mode is provided in an automatic, time-controlled resetting operation. For this, the driving tool has a resetting assembly with a control volume. The resetting assembly can be activated in the bump firing mode, by air at a working pressure being admitted into the control volume. The control volume is provided with an air-venting opening, which allows slow venting of the air. If the pressure goes below a limit value, this has the effect after a predetermined delay time of transferring the driving tool into the single shot mode. A separate valve, the valve piston of which is coupled to the workpiece contact element, is provided for the activation of the resetting assembly. An actuation of the workpiece contact element consequently leads to an activation of the resetting assembly. This is intended to achieve the effect that, when the driving tool is not used over a certain delay time, there is a correspondingly automatic, time-controlled resetting of the driving tool from the bump firing mode into the single shot mode in a resetting operation.

SUMMARY

The invention addresses the problem of designing and developing the known driving tool in such a way that user convenience, with regard to the automatic resetting operation, is further increased.

The above problem is solved in the case of a driving tool according to some embodiments.

Essential to this is the fundamental consideration that informing the user about a resetting operation that is pending, is in progress or has taken place, which of course takes place in a time-controlled manner and to that extent automatically, leads to an increase in user convenience. For example, this makes it possible to avoid the situation in which the user places the driving tool onto a tool, with the trigger lever actuated, after the automatic resetting operation has already taken place. To be precise, this would have the effect, surprisingly for the user, that the placing of the driving tool, and the associated actuation of the workpiece contact element, would not be accompanied by a fastening means being driven in, since the driving device is already in the single shot mode.

It is specifically proposed that a signaling assembly, which emits a feedback signal to the user before, after or during each automatic resetting operation, is provided. In the simplest case, the feedback signal makes the user aware that the resetting operation is taking place or has already taken place. On this basis, the user can decide whether to continue operating in single shot mode or to transfer the driving tool to bump firing mode.

In a preferred alternative, the signaling assembly emits a feedback signal at a predetermined time interval before the automatic resetting operation. In this way, the user can be warned that the resetting operation is pending. The user can then decide, for example, to start a further driving-in cycle, in order to remain in bump firing mode.

The feedback signal that can be emitted by the signaling assembly may preferably be an optical signal, an acoustic signal or a haptic signal. A combination of these various types of signal is also conceivable.

According to a further teaching, which is likewise of independent significance, a method for operating the driving tool is disclosed.

What is essential according to this further teaching is that a signaling assembly explained above, by means of which a feedback signal is emitted to the user before, after or during each resetting operation, is provided. Reference may be made to all of the statements made in relation to the operation of the driving tool as proposed.

BRIEF DESCRIPTION OF THE FIGURES

The invention is explained in more detail below on the basis of drawings that merely shows exemplary embodiments. In the drawings.

In the figures, the same reference signs/numerals are used for identical or similar components, even if a repeated description is omitted for reasons of simplicity.

DETAILED DESCRIPTION

Figure 1:
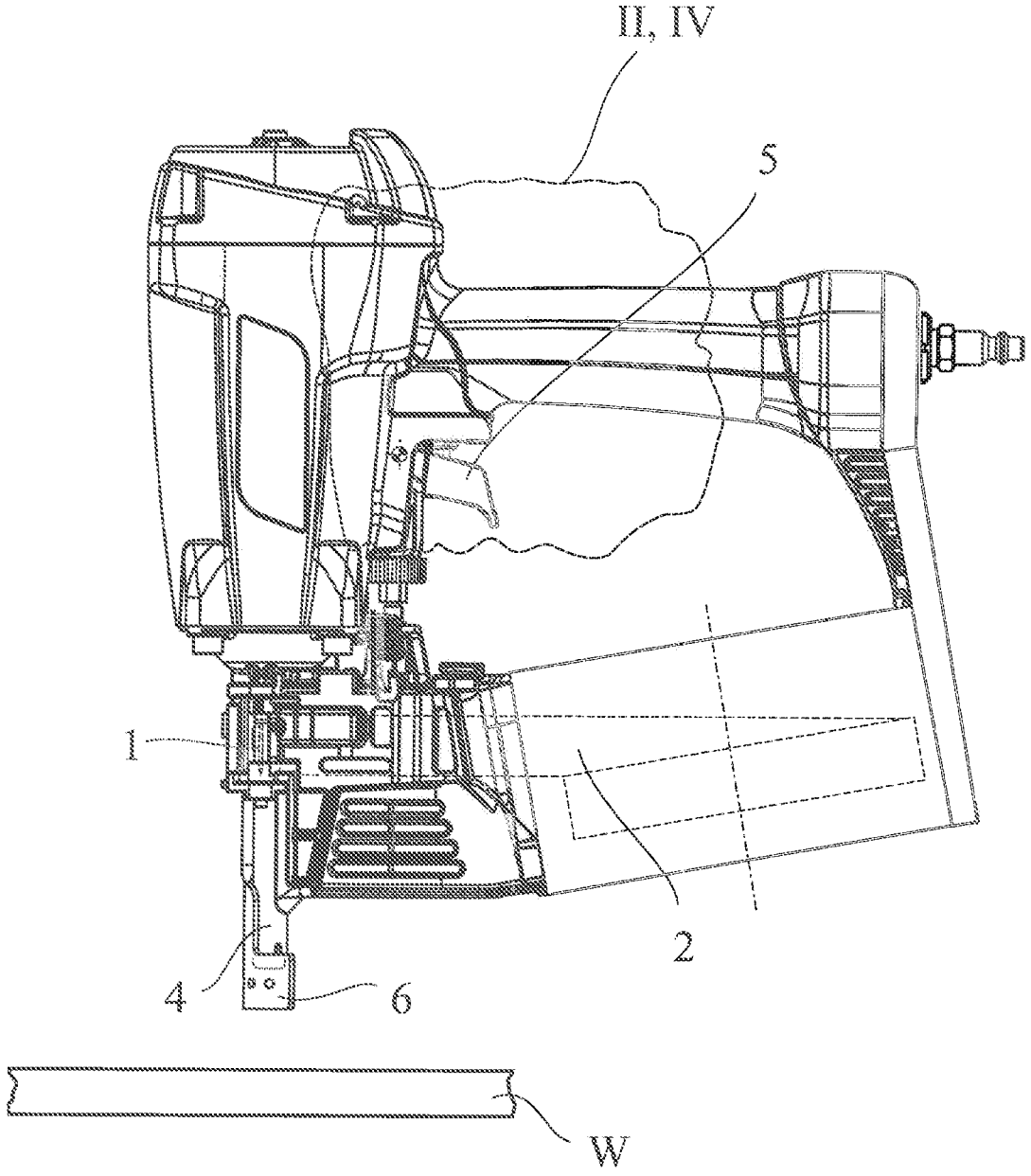
FIG. 1 shows a driving tool as proposed, in a side view.

The driving tool that is represented in the drawing serves for driving in fastening means 1 of a magazine belt 2 indicated in FIG. 1, in particular nails, staples or the like. With regard to further interpretation of the term "fastening means", reference may be made to the introductory part of the description.

The driving in of nails is the main focus of attention in the description that follows, which should not be understood as being restrictive. All statements that are made with respect to nails apply correspondingly to all other types of fastening means that can be driven in.

The driving tool is a compressed-air driving tool with a pneumatic actuator unit 3 schematically represented in the drawing, by means of which the fastening means 1 can be driven into the workpiece Win driving-in cycles. In a driving-in cycle, the fastening means 1, driven by the pneumatic actuator unit 3, pass through a driving channel 4 into the workpiece W.

The driving tool as proposed also has a trigger lever 5, which can be actuated manually. The trigger lever 5 represented in the drawing can be pivoted about a trigger lever axis 5*a* for actuation.

In order to avoid unintentional triggering of driving-in cycles, also provided is a workpiece contact element 6, which can be actuated by the placing of the workpiece contact element 6 onto the workpiece W. The workpiece contact element 6 can be resiliently deflected upward in FIG. 1 for actuation.

The driving tool can be operated in different operating modes, depending on the application. Firstly, the driving tool can be operated in a single shot mode, in that each individual sequence of an actuation of the workpiece contact element 6, with subsequent actuation of the trigger lever 5, triggers a driving-in cycle. In the single shot mode, the user therefore first places the driving tool onto the workpiece W, thereby actuating the workpiece contact element 6, and subsequently actuates the trigger lever 5. This sequence leads to the triggering of the driving-in cycle. If the fastening means 1 are to be driven in at a multiplicity of driving-in locations lying next to one another, the driving tool can be advantageously operated in bump firing mode. In bump firing mode, with the trigger lever 5 continuously actuated, each individual actuation of the workpiece contact element 6 triggers a driving-in cycle. If the user keeps the trigger lever 5 actuated, the placing of the driving tool, and consequently the actuation of the workpiece contact element 6, is sufficient for the triggering of a driving-in cycle.

It is preferably the case that the completely unactuated driving tool is initially in the single shot mode. This means that, for triggering the first driving-in cycle, first the workpiece contact element 6 and then the trigger lever 5 must be actuated. After this first driving-in cycle, the driving tool is preferably in the bump firing mode. The user then has the possibility of keeping the trigger lever 5 actuated and triggering a further driving-in cycle with each actuation of the workpiece contact element 6.

The handling of the driving tool as proposed is made particularly convenient by providing a resetting assembly 7 that is schematically represented in the drawings, by means of which the driving tool can be reset from the bump firing mode into the single shot mode in an automatic, time-controlled resetting operation. This means that such are setting operation is automatically initiated in accordance with a certain specification, on the basis of a time control, for example on the basis of a specific time sequence. Correspondingly, the resetting assembly 7 is provided with a time-control device of some kind or other.

It is therefore essential to provide a signaling assembly 8, which is likewise only schematically represented in the drawing and which emits a feedback signal to the user before, after or during each automatic resetting operation that is initiated by the resetting assembly 7. Consequently, depending on the design, it is possible for the user to be informed simply as to whether an automatic resetting operation is pending, has already taken place or is in the process of taking place.

Numerous advantageous variants are conceivable for the structural design of the resetting assembly 7. It is preferably the case that the resetting assembly 7 can be activated in the 10 bump firing mode and, after a delay time starting from the activation, has the effect of automatically transferring the driving tool from the bump firing mode into the single shot mode.

The activation of the resetting assembly 7 is possible in various ways. Here and preferably, the resetting assembly 7 is coupled to a pneumatic actuator unit 3, by means of which the fastening means 1 can be driven into the workpiece W in driving-in cycles, a driving-in cycle activating the resetting assembly 7 in bump firing mode. It may alternatively be provided that the resetting assembly 7 can be activated by a predetermined actuation of the trigger lever 5 and/or of the workpiece contact element 6, for example by the workpiece contact element 6 coming away from a workpiece W.

To sum up, an automatic resetting operation preferably takes place after a delay time starting from the last driving-in cycle or after a delay time starting from the last user actuation and directed at triggering a driving-in cycle.

In principle, it may be provided that the signaling assembly 8 emits a feedback signal during every resetting operation that is initiated by the resetting assembly 7. This makes it clear to the user that the driving tool has been reset to the single shot mode. In the case of a particularly preferred design, it is however the case that the signaling assembly 8 emits a feedback signal at a predetermined time interval before the resetting operation.

This allows the user to respond, for example in that, with the trigger lever 5 actuated, the user actuates the workpiece contact element 6 and thereby triggers a further driving-in cycle. Consequently, the resetting assembly 7 described above involves renewed activation of the resetting assembly 7, and so the driving tool at first remains in the bump firing mode. Alternatively or in addition, it may be provided that the signaling assembly 8 emits a feedback signal at a predetermined time interval after the resetting operation. This would inform the user that the resetting operation has been safely completed.

Depending on the application, it may also be advantageous that the signaling assembly 8 emits a differing feedback signal, depending on the time interval from the resetting operation. For example, the signaling assembly 8 could emit a cyclical signal, the cycle time of which is continuously reduced as the resetting operation approaches.

A particularly low-cost structure can be achieved by the signaling assembly 8 being operated electrically. Numerous electrically operated variants for the emission of a feedback signal are known.

In a particularly preferred design, the driving tool is operated electrically, the signaling assembly 8 being operated by the voltage supply of the driving tool. Alternatively, the signaling assembly 8 may also be assigned a separate voltage supply, in particular a battery assembly or the like.

It is also advantageous that the signaling assembly 8 is operated pneumatically. This is advantageous in particular if the driving tool itself is operated pneumatically, the signaling assembly 8 preferably relying on the compressed air supply of the driving tool.

Figure 4:
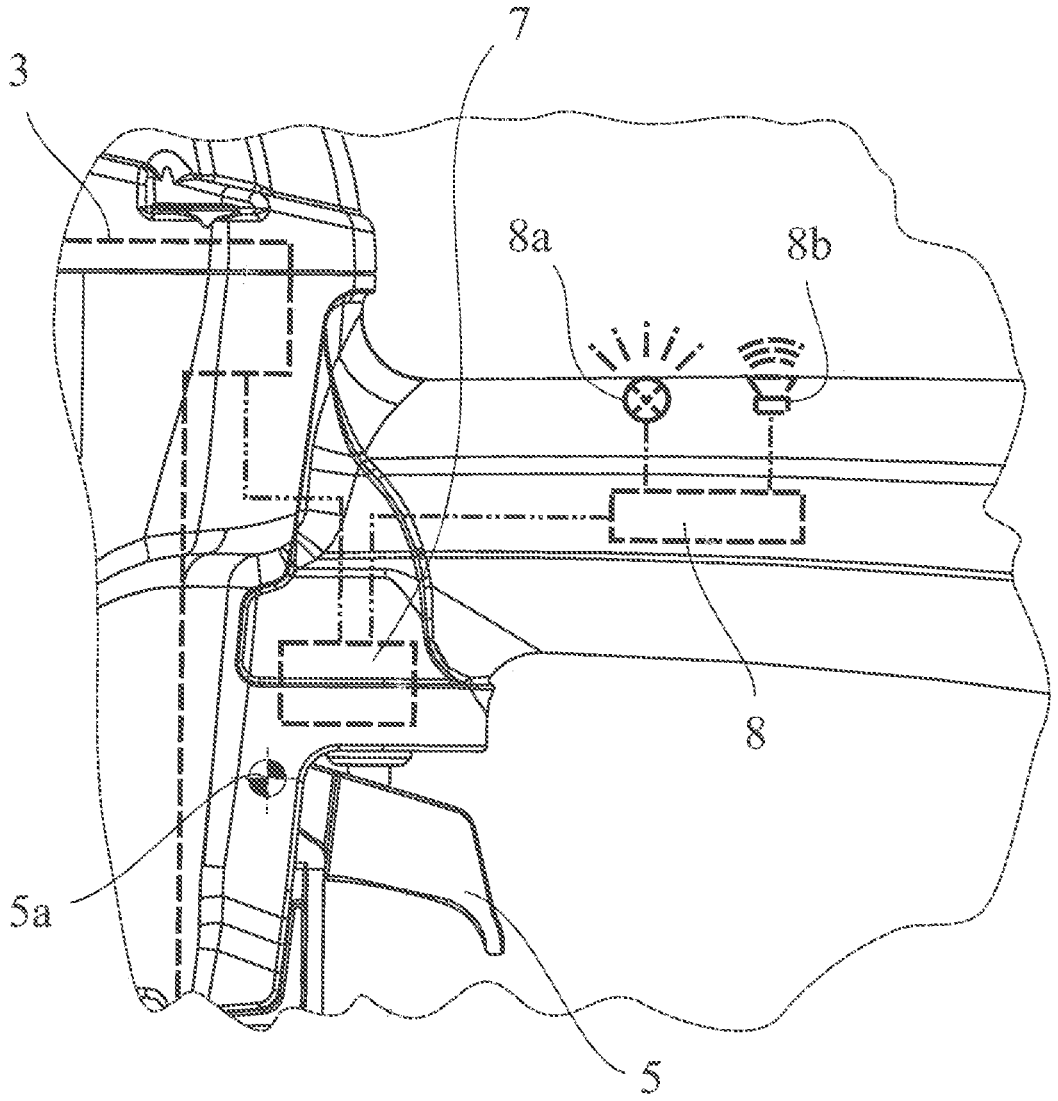
FIG. 4 shows a driving tool according to FIG. 1 in a further embodiment, in the view of a detail IV.

Depending on the application, completely different variants are conceivable for the feedback signal of the signaling assembly 8. For example, the feedback signal may be an optical signal (FIG. 4). It is then preferably the case that the signaling assembly 8 has a corresponding light source 8*a*. The light source 8*a* may be, for example, a light-emitting diode assembly or the like. Alternatively, the signaling assembly 8 may have a mechanical display. For example, the signaling assembly 8 may have a display element, in particular, a colored display element, which can be presented in a display window.

Alternatively or in addition, however, it may also be the case that the feedback signal that can be emitted by the signaling assembly 8 is an acoustic signal, the signaling assembly preferably having for this a sound generator 8*b* (FIG. 4). Such a sound generator may be an electrical buzzer, an electrical loudspeaker, a pneumatic whistling assembly or the like.

Figure 2:
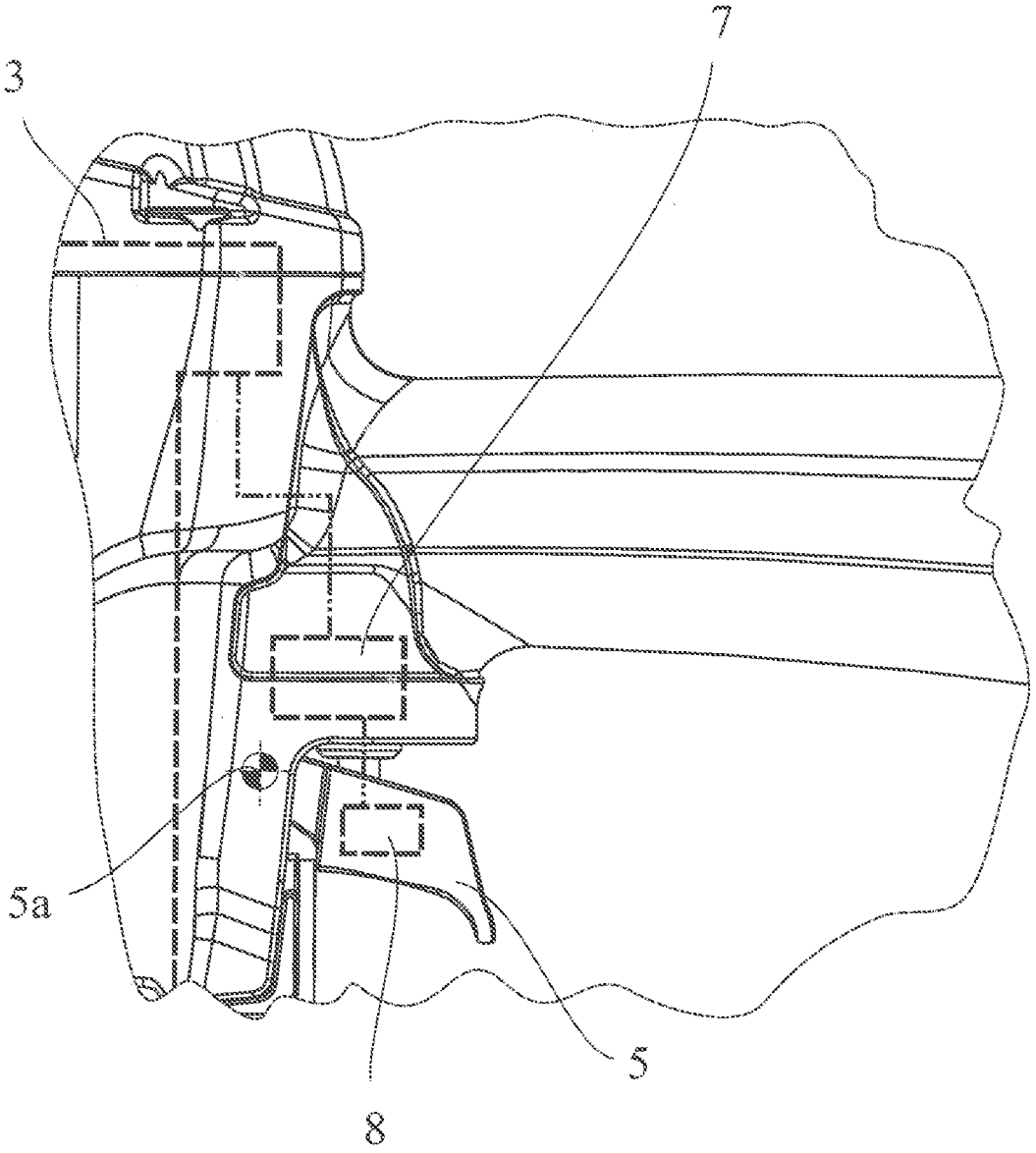
FIG. 2 shows the driving tool according to FIG. 1, in the view of a detail II.
Figure 3:
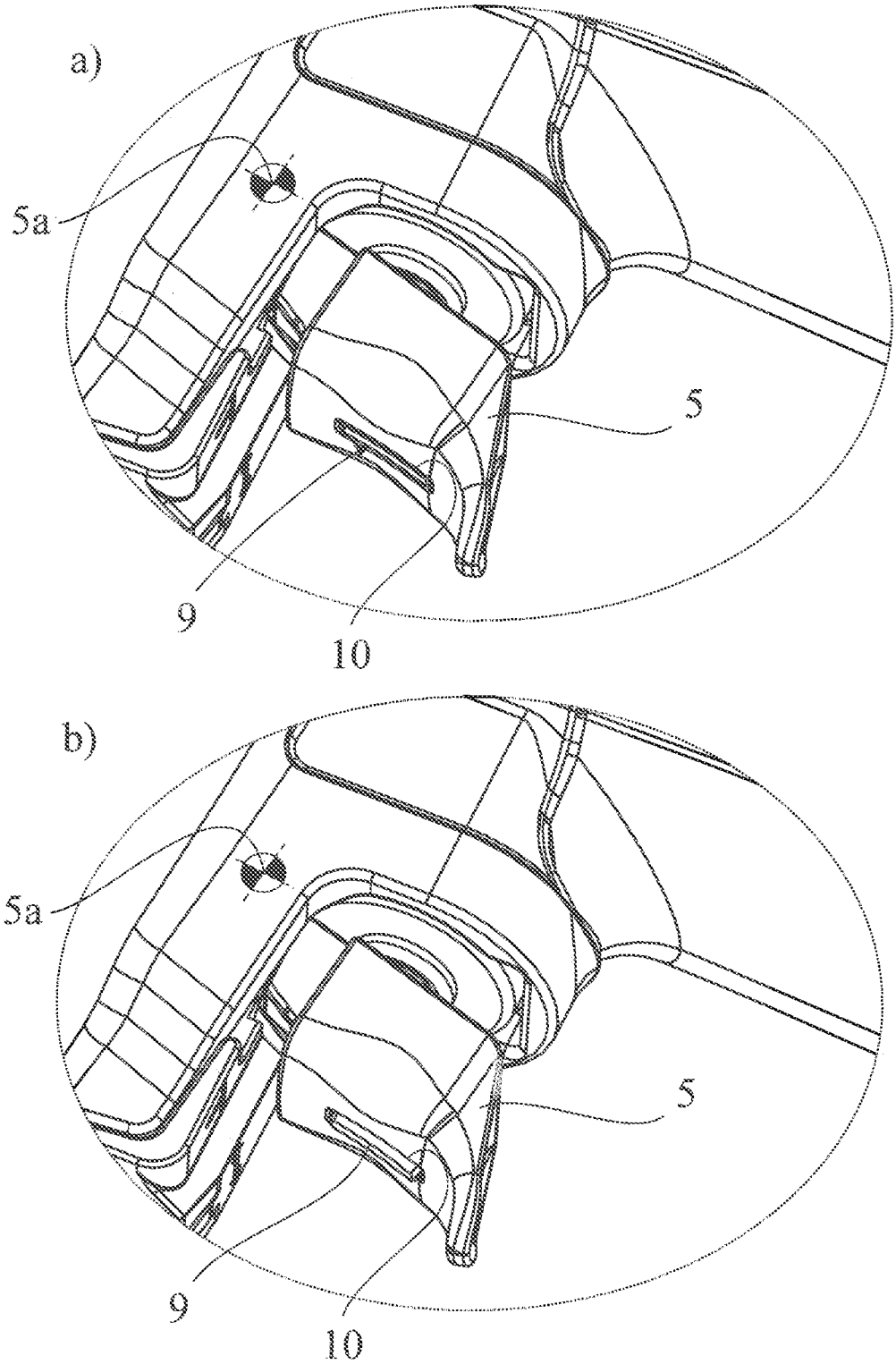
FIG. 3 shows the trigger lever of the driving tool according to FIG. 1 a) in the actuated state without the feedback signal from the signaling assembly, and b) in the actuated state with the feedback signal from the signaling assembly.

In a particularly preferred design, however, it is the case that the feedback signal that can be emitted by the signaling assembly 8 is a haptic signal (FIGS. 1-3). In this case, the signaling assembly 8 preferably has a signaling movement drive for generating a tangible signaling movement, a signaling pulse generator for generating a tangible signaling pulse or a signaling vibrator for generating a tangible signaling vibration.

The above, haptic signals of the signaling assembly 8 can be felt best by the user when the signaling assembly 8 is at least partly integrated in the trigger lever 5.

The signaling assembly 8 advantageously has a feeling element 9, which can be adjusted for the emission of a haptic feedback signal and can be seen in the representation according to FIG. 3. In this case, the feeling element 9 is preferably integrated in the trigger lever 5, as the representation according to FIG. 3 likewise shows. In the case of the exemplary embodiment represented in FIG. 3, the feeling element 9 is adjustable with respect to the trigger lever 5 for the emission of the haptic feedback signal. Specifically, the trigger lever 5 forms a receptacle for the feeling element 9, the feeling element 9 protruding through an opening 10 in the trigger lever 5, at least for the emission of a feedback signal. This is evident from viewing FIGS. 3*a*) and 3*b*) together. In FIG. 3*a*), the signaling assembly 8 is not yet emitting a feedback signal. In FIG. 3*b*), the signaling assembly 8 is emitting a feedback signal, in that the feeling element 9 is made to project through the slit-like opening 10 in the trigger lever 5. For this, the feeling element 9 is preferably coupled to an aforementioned signaling movement drive.

A particularly simple structure is obtained, however, by the signaling assembly 8 being a component part of the resetting assembly 7, in particular if the signaling assembly 8 serves for generating haptic feedback signals. This is attributable to the consideration that the resetting assembly 7 must in any case implement an adjusting movement of some kind or other for the implementation of the resetting operation, and this can be used for generating the haptic feedback signals.

Specifically, the resetting assembly 7 is preferably provided with a resetting element, which is adjusted into a resetting position for the resetting of the driving device into the single shot mode, the adjustment of the resetting element into the resetting position being triggered by generation of the feedback signal. The adjustment of the resetting element into the resetting position preferably brings about a corresponding adjustment of the feeling element 9, here and preferably through the slit-like opening 10 in the trigger lever 5, as a feedback signal.

According to a further teaching, which is of independent significance, a method for operating a driving tool as proposed is disclosed.

The driving tool correspondingly has a trigger lever 5, which can be actuated manually, and a workpiece contact element 6, which can be actuated by placing the driving tool onto the workpiece W, and can be operated in a single shot mode and in a bump firing mode. Also provided is a resetting assembly 7, by means of which the driving tool is reset from the bump firing mode into the single shot mode in a time-controlled resetting operation.

What is essential according to the further teaching is that a signaling assembly 8 is provided, by means of which a feedback signal is emitted to the user before, after or during every resetting operation. Reference may be made to all of the statements made with respect to the operation of the driving tool as proposed.

The invention claimed is:

1. A driving tool for driving a fastener into a workpiece, the driving tool comprising:

a housing;

a trigger lever supported by the housing, the trigger lever defining an opening through which a feeling element is movable to produce a haptic feedback signal;

a workpiece contact element supported by the housing, wherein the trigger lever and the workpiece contact element are configured to operate in: (a) a single shot mode in which each actuation of the workpiece contact element followed by an actuation of the trigger lever causes one of a plurality of fastener driving-in cycles, and (b) in a bump firing mode in which, with the trigger lever continuously actuated, each actuation of the workpiece contact element causes one of the plurality of fastener driving-in cycles;

a resetting assembly supported by the housing and configured to automatically cause a change from the bump firing mode to the single shot mode after a designated amount of delay time from a latest one of the plurality of fastener driving-in cycles; and a signaling assembly supported by the housing and including the feeling element, the signaling assembly configured to emit a plurality of different feedback signals associated with the resetting assembly causing the automatic change from the bump firing mode to the single shot mode, wherein the plurality of different feedback signals include the haptic feedback signal produced by movement of the feeling element relative to the trigger lever, and at least one of an acoustic feedback signal and an optical feedback signal.

2. The driving tool of claim 1, wherein the signaling assembly is configured to emit the plurality of different feedback signals during a time period before the resetting assembly causes the automatic change from the bump firing mode to the single shot mode.

3. The driving tool of claim 1, wherein the signaling assembly is configured to emit the plurality of different feedback signals during a time period when the resetting assembly causes the automatic change from the bump firing mode to the single shot mode.

4. The driving tool of claim 1, wherein the signaling assembly is configured to emit the plurality of different feedback signals during a time period after the resetting assembly causes the automatic change from the bump firing mode to the single shot mode.

5. The driving tool of claim 1, which is pneumatically powered, and wherein the signaling assembly is pneumatically controlled.

6. The driving tool of claim 1, which is pneumatically powered, and wherein the signaling assembly is electrically controlled.

7. The driving tool of claim 1, wherein the trigger lever defines a receptacle for the feeling element.

8. The driving tool of claim 1, wherein the signaling assembly is configured to emit the haptic feedback signal in the form of one of a pulsed haptic feedback signal and a vibratory haptic feedback signal.

9. The driving tool of claim 1, wherein the signaling assembly includes an optical signal device configured to emit one of the plurality of different feedback signals as the optical feedback signal.

10. The driving tool of claim 9, wherein the optical signal device includes at least one electrically powered light emitting diode.

11. The driving tool of claim 9, wherein the optical signal device includes a window and a colored display viewable through the window.

12. The driving tool of claim 1, wherein the signaling assembly includes a sound generation device and is configured to emit the one of the plurality of different feedback signals as the acoustic feedback signal.

13. The driving tool of claim 1, wherein the signaling assembly includes a haptic signal device, an optical signal device, and a sound generation device.

14. A driving tool for driving a fastener into a workpiece, the driving tool comprising:

a housing;

a trigger lever supported by the housing, the trigger lever defining an opening through which a feeling element is movable to produce a haptic feedback signal;

a workpiece contact element supported by the housing, wherein the trigger lever and the workpiece contact element are configured to operate in: (a) a single shot mode in which each actuation of the workpiece contact element followed by an actuation of the trigger lever causes one of a plurality of fastener driving-in cycles, and (b) in a bump firing mode in which each actuation of the workpiece contact element causes one of the plurality of fastener driving-in cycles;

a resetting assembly supported by the housing and configured to automatically cause a change from the bump firing mode to the single shot mode after a designated amount of delay time from a latest one of the plurality of fastener driving-in cycles; and a signaling assembly supported by the housing and including the feeling element, the signaling assembly configured to emit a plurality of feedback signals associated with the resetting assembly causing the automatic change from the bump firing mode to the single shot mode, wherein the feedback signals include the haptic feedback signal produced by movement of the feeling element relative to the trigger lever, and at least one of an acoustic feedback signal and an optical feedback signal.

15. The driving tool of claim 14, wherein the signaling assembly is configured to emit the feedback signals during one of: (a) a time period before the resetting assembly causes the automatic change from the bump firing mode to the single shot mode, (b) a time period during the resetting assembly causes the automatic change from the bump firing mode to the single shot mode, and (c) a time period after the resetting assembly causes the automatic change from the bump firing mode to the single shot mode.

* * * * *